US009064652B2

(12) United States Patent
Boget

(10) Patent No.: US 9,064,652 B2
(45) Date of Patent: Jun. 23, 2015

(54) ELECTRICAL SWITCH, OF THE NORMALLY-CLOSED TYPE, ESPECIALLY FOR A PORTABLE COMMUNICATION DEVICE

(75) Inventor: Christophe Boget, Varennes-Vauzelles (FR)

(73) Assignee: THALES, Neuilly sur Seine (FR)

( * ) Notice: Subject to any disclaimer, the term of this patent is extended or adjusted under 35 U.S.C. 154(b) by 387 days.

(21) Appl. No.: 13/699,878

(22) PCT Filed: May 26, 2011

(86) PCT No.: PCT/FR2011/051196

§ 371 (c)(1),
(2), (4) Date: Feb. 6, 2013

(87) PCT Pub. No.: WO2011/148105

PCT Pub. Date: Dec. 1, 2011

(65) Prior Publication Data

US 2013/0134026 A1 May 30, 2013

(30) Foreign Application Priority Data

May 26, 2010 (FR) ..... 10 02193
Dec. 22, 2010 (FR) ..... 10 05040

(51) Int. Cl.

| | |
|---|---|
| ***H01H 13/807*** | (2006.01) |
| ***H01H 13/705*** | (2006.01) |
| ***H01B 5/02*** | (2006.01) |
| ***H01H 1/10*** | (2006.01) |
| ***H01H 13/88*** | (2006.01) |

(52) U.S. Cl.

CPC ..... *H01H 13/705* (2013.01); *Y10T 29/49002* (2015.01); *H01H 13/807* (2013.01); *H01H 2203/026* (2013.01); *H01H 2205/03* (2013.01); *H01H 2207/012* (2013.01); *H01H 2221/044* (2013.01); *H01H 2225/004* (2013.01); *H01H 2225/012* (2013.01); *H01H 2227/036* (2013.01); *H01H 2235/028* (2013.01); *H01B 5/02* (2013.01); *H01H 1/10* (2013.01); *H01H 13/88* (2013.01)

(58) Field of Classification Search

CPC ..... H01H 13/807; H01H 13/70; H01H 13/702–13/705; H01H 1/10; H01H 13/88
USPC ..... 200/512–517, 406
See application file for complete search history.

(56) References Cited

U.S. PATENT DOCUMENTS

| | | | | |
|---|---|---|---|---|
| 4,118,609 | A * | 10/1978 | Schadow et al. | 200/460 |
| 4,618,754 | A | 10/1986 | Gross | |
| 6,130,593 | A * | 10/2000 | Van Zeeland | 200/514 |
| 6,466,118 | B1 * | 10/2002 | Van Zeeland et al. | 200/512 |
| 6,989,728 | B2 * | 1/2006 | Van Zeeland et al. | 200/512 |

FOREIGN PATENT DOCUMENTS

| | | |
|---|---|---|
| BE | 658280 A | 4/1965 |
| FR | 2841037 A1 | 12/2003 |

OTHER PUBLICATIONS

International Search Report, dated Sep. 13, 2011, which issued during the prosecution of International Patent Application No. PCT/FR2011/051196.

* cited by examiner

*Primary Examiner* — Amy Cohen Johnson
*Assistant Examiner* — Marina Fishman
(74) *Attorney, Agent, or Firm* — Troutman Sanders LLP

(57) ABSTRACT

The switch includes a printed circuit, of generally plane shape, and comprising a first face bearing a first contact pad, a second face, opposite the first, bearing a second contact pad, and a through-orifice allowing access between the first face and the second face. The switch also includes a conductor, having a first part, which cooperates with the first contact pad, and a second part, which extends between a first end, fixed to the first part, and a free second end, passing through the orifice. The second part is elastically deformable between a rest position, in which its second end cooperates with the second contact pad, and a stressed position, in which its second end is moved away from the second contact pad.

16 Claims, 3 Drawing Sheets

ELECTRICAL SWITCH, OF THE NORMALLY-CLOSED TYPE, ESPECIALLY FOR A PORTABLE COMMUNICATION DEVICE

CROSS-REFERENCE TO RELATED APPLICATIONS

This application is a national stage application of International Application PCT/FR2011/051196 filed May 26, 2011. The PCT application published as WO 2011/148105 on Dec. 1, 2011. The PCT application claims priority to French Application No. 1002193 filed on May 26, 2010 and French application Ser. No. 10/05040 filed Dec. 22, 2010. The present application claims priority to and incorporates by reference all of the above applications.

The present invention relates to an electrical push button switch, of the normally closed type, in particular intended for use with the keypad of a portable communication device. The invention also relates to the manufacture of a flexible electrical contact keypad of the normally closed type, the corresponding flexible keypad, the key and contact strip.

It should be reminded that a switch may flip between a closed position in which it allows an electric current to pass, and an open position, in which it interrupts the flow or passage of this electric current. A push button switch is said to be of the normally closed type when it is brought back to its closed position in the absence of external stress, and when it passes into its open position when actuated by a user, particularly by means of the push button.

The current membrane keypads that are extremely fine and inexpensive are manufactured by printing silver based conductive ink tracks on plastic substrates in order to create extra fine circuits.

The keys of the keypad thus formed are all executed according to the same principle: at least two tracks are arranged facing one another and are contacted when the key is pressed. These keys are therefore normally open type electrical contact keys.

The electrically conductive member that enables the contacting is, as appropriate, either a metal cup forming a cup contact, or a silver dot printed on the back of the upper circuit or the back of the decorative face placed on the circuit. This type of contact is thus designated as comb contact with flat or thermoformed front face.

The above techniques enable the production of membrane keypads, which have reduced thicknesses of the order of 1 to 1.5 mm, or in the most elaborate cases, even of 0.6 to 0.7 mm.

The development of the aforementioned techniques has made it possible, more recently to integrate extra fine components into membrane keypads, components such as light emitting diodes LED or small resistors, whose thickness of the order of 0.5 mm allows their integration in these fabrications.

However, when the use of more complex components appears to be necessary, it is imperative to change the technology. Larger circuits are then most often bonded on to machined metal plates, which are used to support the integration of buttons, switches, emergency stop buttons or other elements.

When integrators of such circuits or keypads wish to take advantage in this type of circuit or keypad of one or more normally closed type electric contact keys, in which two or more conductive tracks are in permanent contact, the action of an operator on one of the keys serving to open the contact, it is now necessary to either integrate buttons that are bulky and constraining in terms of implementation costs, or to introduce electronic management of this type of contact, which many integrators do not want to or cannot execute.

For example, from the technical state of the art, in particular from EP 0 793 246, an electric push button switch, of the normally closed type is already known. Such a switch conventionally comprises a printed circuit, comprising first and second contact pads, and an electrical conductor for electrically connecting the first and second contact pads.

Such a switch of the normally closed type has numerous elements, and therefore is particularly costly and complex to implement. Moreover, on account of its complexity and size, such a switch is not generally suitable for the keypad of a portable communication device.

The present invention aims to overcome these drawbacks by providing an electric push button switch, of the normally closed type, having a structure that is simple, economical and compact.

Specifically, the invention relates in particular to the implementation of a process for the manufacture of a flexible electrical contact keypad of the normally closed type, of a normally closed type contact key and a keypad having at least one such key, while retaining the advantages inherent in the flexible keypad technology, namely:

- maintaining a very thin keypad, its thickness not exceeding 1 to 1.5 mm, according to the construction;
- conservation of the operating principle of cup or thermoformed keys that are used in membrane keypads at the present time;
- maintaining a manufacturing cost structure that is competitive and compatible with the specifications of existing markets that are seeking quality products at low costs;
- obtaining a type of key that can function hundreds of thousands of times, or more, without any reasonably foreseeable problems;
- making available a semi finished product that is easy to implement for integrators without additional constraints related to adaptation of their working methods
- producing a final product, that is a flexible membrane keypad, durable enough to withstand sometimes difficult conditions of use such as vibration, shock or other conditions.

An object of the present invention is in particular the implementation of a method for the manufacture of a flexible membrane keypad comprising of at least one normally closed type contact key.

This method is remarkable in that it consists at minimum, of equipping the keypad with at least one circuit board printed on both sides comprising of at least one front contact face and one back contact face; of providing in the printed circuit, between the front contact face and the back contact face, an insertion slot; of inserting into the slot one flexible conducting strip forming a normally closed electrical contact between the front contact face and the back contact face, this flexible conducting strip having a pressure point so as to enable the exertion of a force for breaking the normally closed electrical contact.

Advantageously, the flexible conducting strip comprises of a flexible center tab that includes the pressure point, which is electrically and mechanically joined and adjacent to a first side tab and a second side tab by a common point, the first and the second side tabs being placed in one and the same plane and the center tab being arranged in an offset position in an orthogonal direction to said plane so as to form a first and a second insertion space for inserting the flexible strip in the slot, the operation consisting of inserting includes at least one step consisting of inserting said flexible strip into the slot by clipping of the first and second insertion space on the opposite edges of the slot, in a manner so as to bring the flexible center tab to rest and respectively at least one of the first or second side tabs in electrical contact with the back contact face and respectively the front contact face or vice versa.

Preferably, the pressure point provided on the center tab is placed in distant offset position on the center tab in relation to the common point so as to form a cross-force lever between the contact point of the center tab on the back or front contact face and the common point.

Another object of the present invention is the implementation of a flexible contact strip of normally closed type for the double sided printed circuit board.

Such a flexible contact strip is remarkable in that it comprises at least one flexible center tab, and a first side tab and a second side tab that are electrically and mechanically joined to the same common point. The electrically and mechanically joined first side tab and second side tab are substantially placed in the same plane, laterally adjacent to the flexible center tab. The center tab is arranged in offset position in an orthogonal direction to the plane so as to form a first and a second insertion space for inserting the printed circuit board that is provided with one slot and at least one front contact face and one back contact face each disposed in the vicinity of one of the two opposite edges of the slot.

Advantageously, the contact face of the flexible center tab is formed by a boss, and, optionally, the contact faces of the first side tab and the second side tab are also formed by a boss.

Preferably, the flexible center tab is offset at rest in an oblique plane in relation to the plane containing the first flexible side tab and the second flexible side tab to form by opposite constrained rotation of the flexible center tab, the first and second insertion spaces of the printed circuit board between this flexible center tab and the first and second side tabs, respectively.

Advantageously, the strip has been derived from the cutting/stamping of a sheet of conductive material.

Another object of the present invention is the implementation of a contact key for the flexible membrane keypad, such a contact key being remarkable in that it comprises of at least one printed circuit board provided with at least one front contact face and one back contact face, each placed in the vicinity of one of the opposite edges of a slot provided in the printed circuit board, and a flexible contact strip according to the invention inserted into the slot and forming a normally closed electrical contact between the front contact face and the back contact face. The flexible strip includes a pressure point for enabling the exertion of a force for breaking the normally closed electrical contact.

Advantageously, the pressure point can be actuated by pressure on a cup or a touch pad disposed over it.

The invention also relates to a flexible membrane keypad having at least one corresponding key and/or one flexible contact strip of the normally closed type.

The manufacturing process, the corresponding keypad and the normally closed type electrical contact key, objects of the invention, find application in the manufacture of keypads of all sizes, in particular small size keypads for mobile portable phone devices, personal digital assistants (PDAs) and keypads and keyboards of larger dimensions such as keypads and keyboards for laptops or desk top computers, musical instruments or the like.

The invention also relates to an electrical push button switch, of the normally closed type, in particular intended for a portable communication device keypad, comprising of:

- a printed circuit board, including first and second contact pads, and
- an electrical conductor, designed for electrically connecting the first and second contact pads, characterised in that:

- the printed circuit has at least locally a generally plane shape and comprises of a first face bearing a first contact pad, a second face, opposite the first, bearing a second contact pad, and a through-orifice allowing access between the first face and the second face,
- the conductor comprises of a first part, which cooperates with the first contact pad, and
- the conductor comprises of a second part, which extends between a first end, fixed to the first part, and a free second end, passing through the orifice, the second part is elastically deformable between a rest position, in which its second end cooperates with the second contact pad, and a stressed position, in which its second end is moved away from the second contact pad.

Such a switch has a particularly simple structure, wherein the conductor cooperates with the two contact pads without any intermediary and for which it is sufficient to apply a force on the second part of the conductor in order to move this second part away from the second contact pad, and thus open the switch.

Such simplicity of structure is possible in particular thanks to the contact pads arranged on the opposite faces of the printed circuit.

In an optional manner, an electric switch according to the invention may include one or more of the following characteristics, taken alone or based on any of the technically feasible combinations:

- the switch comprises of a metal cup pusher, accessible from the side of the first face of the printed circuit, and movable between a rest position, in which the second part of the conductor is in its rest position, and an engaged position, in which the metal cup cooperates with the second part of the conductor in order to keep it in its stressed position,
- the second part of the conductor has a boss provided between its first and second ends, meant for cooperating with the metal cup when the metal cup is in its engaged position,
- the first part of the conductor comprises of two branches and a base, so as to have a U-shape, the two branches being arranged on either side of the orifice of the printed circuit,
- the second part of the conductor forms a small strip extending the base of the first part, and extending longitudinally between the two branches of the first part,
- the first and second parts are formed integrally, with the conductor for example, being of sheet metal, and
- the switch comprises of means for backlighting, arranged on the side the second face of the printed circuit, and
- the switch includes sealing means covering at least the metal cup and the conductor.

The invention will be better understood upon reading the description which follows, given solely by way of example and by making reference to the accompanying figures in which:

FIGS. 1*a* to 1*d* shows the essential steps for implementing a method for manufacturing a flexible keypad according to an exemplary embodiment of the invention;

Figure 5:
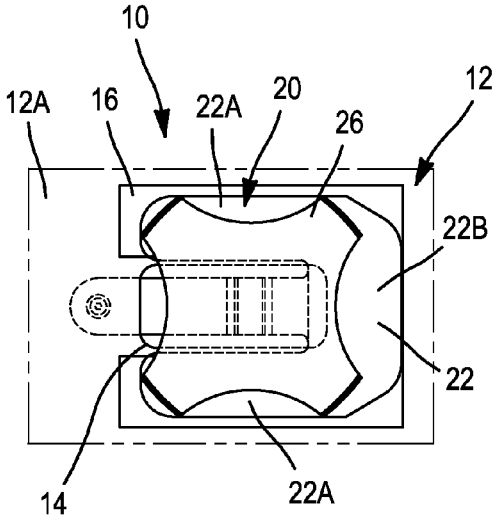
Figure 6:
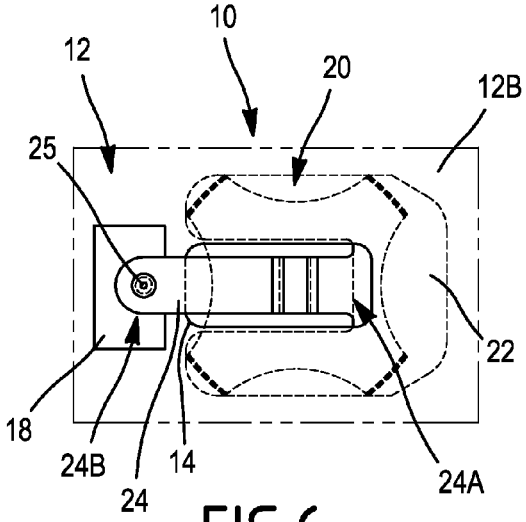
Figure 7:
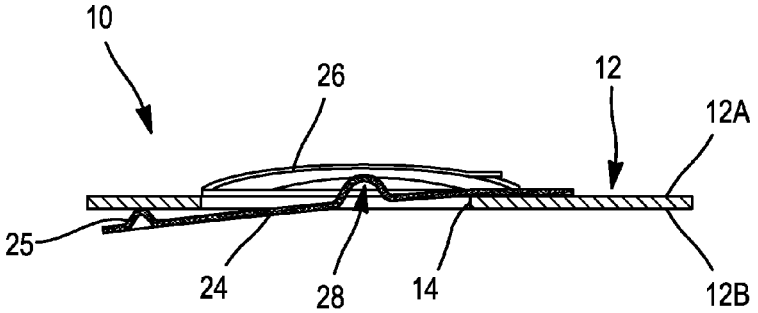
Figure 8:
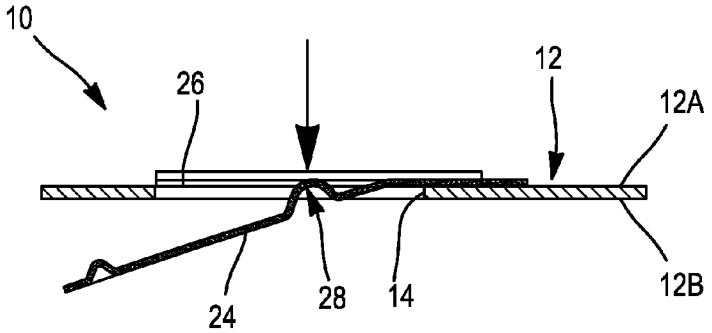

FIGS. 5 and 6 respectively show views from above and below of an electrical switch according to a second exemplary embodiment of the invention;

FIGS. 7 and 8 are cross sectional views of the switch in FIGS. 5 and 6, respectively, in the closed position and the open position.

In the above mentioned figures the relative proportions of the elements have not necessarily been respected, so as not to affect the overall clarity of the illustrations.

The method of manufacturing a flexible membrane keypad according to the object of the present invention is now described in a detailed manner in connection with FIGS. 1*a* to 1*d*.

Figure 1A:
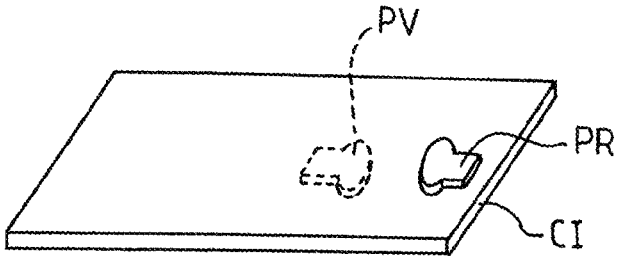

In step 1, shown in FIG. 1*a*, the method according to the invention consists in providing and equipping the keypad with at least one double sided printed circuit board CI comprising of at least one front contact face PR and one back contact face PV.

The double sided printed circuit board CI can be formed by a printed circuit board of any type, a double faced circuit or otherwise.

Figure 1B:
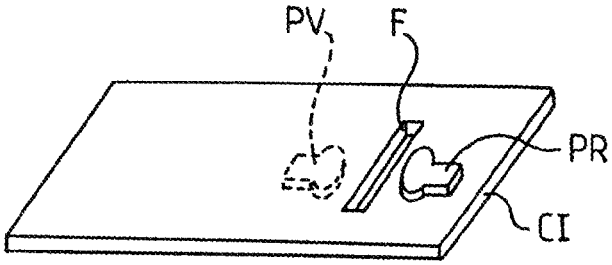

Step 1 is followed by a step 2, shown in FIG. 1*b*, consisting of providing, in the printed circuit CI, between the front contact face PR and the back contact face PV, an insertion slot. Preferably, but without being limited thereto, the insertion slot F is formed by a slot with parallel edges, going through the entire thickness of the printed circuit board CI.

Figure 1C:
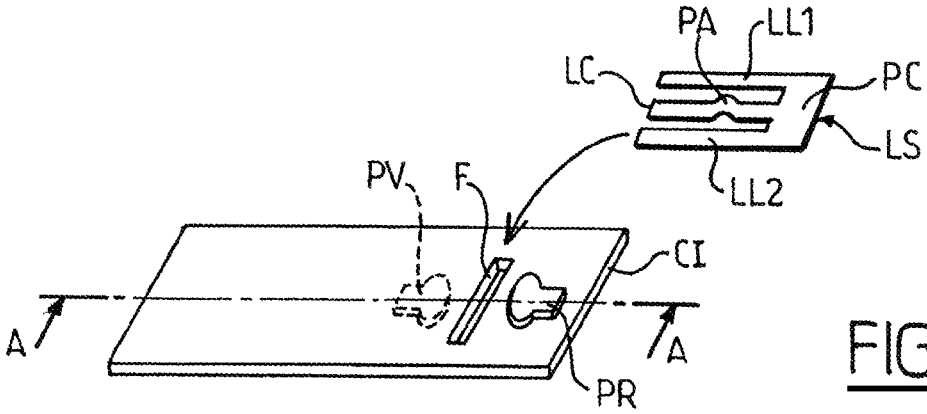

Step 2 is followed by a step 3 comprising of a sub step 3 (1), shown in FIG. 1*c*, consisting of inserting in the insertion slot F one flexible conducting strip LS forming a normally closed electric contact between the front contact face PR and the back contact face PV.

As further shown in the drawings, the flexible strip LS has a pressure point PA that enables the exertion of a force for breaking the normally closed electrical contact.

Figure 1D:
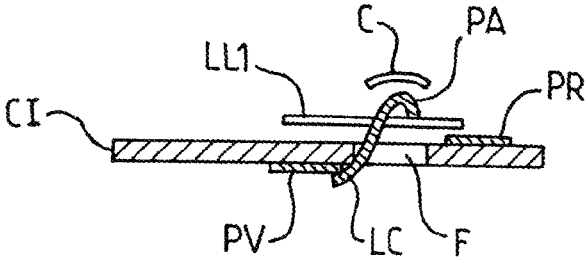

Moreover, in sub step 3 (2), represented in FIG. 1*d*, in a cross sectional view along the AA sectional plane of the printed circuit board CI of FIG. 1*c*, the normally closed electrical contact type contact key obtained upon insertion of the flexible strip LS has been shown. It is understood, in particular, that the insertion operation consists of introducing the flexible strip LS by clipping, or by any other means, on each of the parallel edges of the slot F, as will be described below.

For this purpose, during step 3 (1) shown in FIG. 1*c*, the flexible strip LS may include, preferably, a flexible center tab LC including the pressure point PA, to which is electrically and mechanically joined by a common point PC, and a first side tab LL1 and a second side tab LL2. The flexible center tab LC is adjacent and parallel to the first side tab and the second side tab LL1 and LL2 and joined to the latter by the common point PC. Preferably, the first and second side tabs LL1 and LL2 are placed substantially in the same plane P but the center tab LC is arranged in an offset position in an orthogonal direction to said plane P, in order to form a first insertion space EI1 and a second insertion space EI2, each included between the second flexible tab LC and the opposite ends of the two side tabs LL1 and LL2.

It is thus understood that, in step 3 (1) shown in FIG. 1*c*, the operation of insertion of the flexible strip LS in the slot F is carried out by insertion and clipping of respectively the first insertion space EL1 and the second insertion space EL2 on one of the opposite edges of the slot F, in a manner so as to bring to rest the center tab LC, respectively the two side tabs LLl and LL2 electrically contacting respectively the back contact face PV and the front contact face PR or vice versa.

Finally it can thus also be observed in FIG. 1, that the pressure point PA provided on the center tab LC is placed in distant offset position on the center tab in relation to the common point PC so as to form a cross-force lever between the contact point of the first center tab on the back or front contact face and the common point CP.

A more detailed description of a normally closed type flexible electric contact strip specially designed for the implementation of the process, of a contact key and a flexible membrane keypad in accordance with the object of the present invention will now be given in connection with FIGS. 2 and 3.

Figure 2:
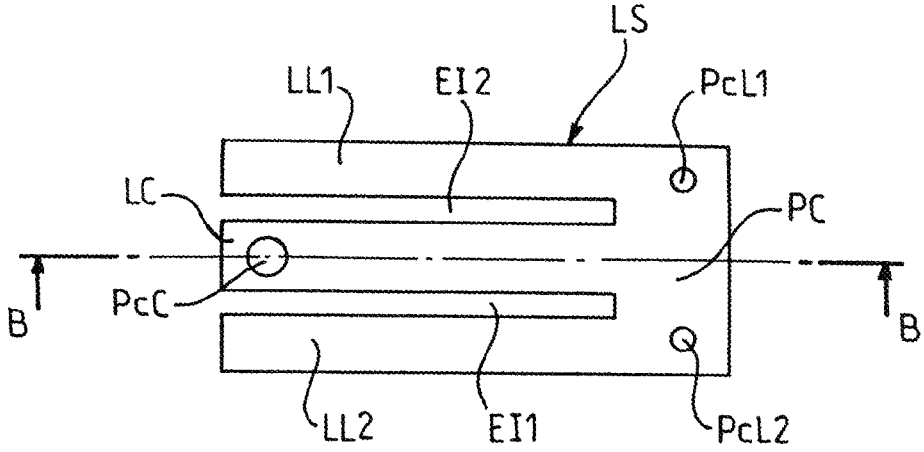
FIG. 2 shows a view from the top of a normally closed type flexible contact strip for double sided printed circuit board in conformity with the object of the present invention.

In FIG. 2 is shown the normally closed flexible contact strip according to the object of the invention comprising of at least one flexible center tab LC, to which it is electrically and mechanically joined at the common point PC.

The flexible strip LS further consists of the first side tab LL1 and the second side tab LL2 each being electrically and mechanically joined by the common point PC.

The first and the second side tabs are adjacent and parallel to the flexible center tab LC, but are arranged to be offset in position in an orthogonal direction to the plane P so as to form the first insertion space EI1 and the second insertion space EI2 for the printed circuit board CI that is provided with the slot F, and the front contact face and the back contact face disposed in the vicinity of the two opposite edges of this slot. With reference to FIG. 2, it is understood that the plane P substantially including the side tabs is none other than the plane of the sheet carrying the above mentioned FIG. 2 and that the insertion spaces EI1 and EI2 shown between the parallel tabs on FIG. 2, however, extend in a direction that is orthogonal to the plane of the same sheet, as will be explained below in connection with FIG. 3.

With reference to the above mentioned figure, it is clear that the flexible center tab LC is offset at rest in an oblique plane PO in relation to the plane P containing the first flexible side tab LL1 and the second flexible side tab LL2 in order to form, through opposite constrained rotation of this flexible center tab LC, the first insertion space EI1 of the printed circuit board CI between this flexible center tab LC and the first and second side tabs LL1 and LL2. The angle of inclination of the oblique plane PO in relation to the above mentioned plane P may be between 10° and 20°, depending on the elasticity characteristics of the metallic material constituting the flexible strip LS.

Figure 3:
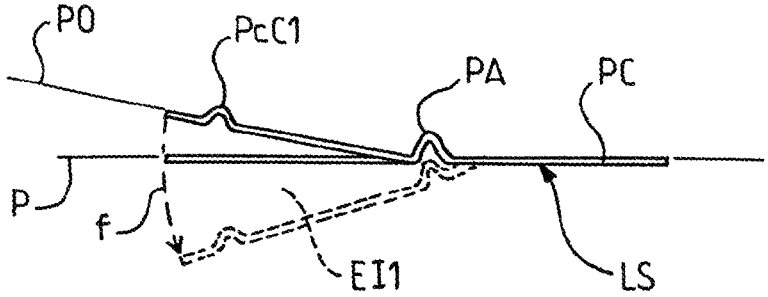
FIG. 3 shows a cross sectional view along the BB sectional plane of the normally closed type flexible contact strip illustrated in FIG. 2.

In FIG. 3, the movement of the center tab LC is shown in dotted lines, in opposite constrained rotation f so as to form the first insertion space EI1 mentioned above.

The flexible strip LS can thus be clipped at its insertion spaces EI2 and EI2 by performing opposite constrained rotation on the flexible center tab LC in order to enable this center tab to pass under the printed circuit CI, the latter entering, by the corresponding edge of the slot F, in the first insertion space EI1; and to enter into electrical contact with the back contact face PV, then, by displacement of the flexible strip LS, towards the opposite edge of the slot F, so as to bring the latter into the second insertion space EI2 and make electrical contact between the front contact face PR and the flexible side tab or tabs LL1, LL2.

Thus, it is to be understood that the center tab LC makes it possible to ensure the function of breaking of the normally closed electrical contact by applying a stress on the pressure point PA in cooperation with the flexible side tabs LLI1 and LL2.

The flexible strip as shown in FIGS. 2 and 3 above, is advantageously derived from cutting/stamping of a sheet of conductive material such as a soft metal like copper-beryllium alloy, steel or some other similar materials.

In particular the pressure point PA provided on the center tab LC is advantageously formed by a boss, for example. Similarly, the contact face PcC1 of the flexible center tab LC is formed, for example, by a boss. In addition, optionally, the contact faces PcL1, PcL2 respectively of side tabs LL1 are also formed by a boss, according to the present embodiment.

A contact key for flexible membrane keypad, according to the object of the invention is now described in connection with FIG. 4.

With reference to the above mentioned figure, the contact key comprises of the printed circuit board CI equipped with the front contact face PR and the back contact face PV each placed in the vicinity of one of the opposite edges of the slot F provided in the printed circuit board. A flexible contact strip LS, as previously described in connection with FIGS. 2 and 3, is inserted into the slot F so as to form the normally closed electrical contact between the front contact face PR and the back contact face PV. The flexible strip includes the pressure point PA for enabling the exertion of the force for breaking the normally closed electrical contact. As was additionally also shown in FIG. 4, the above mentioned pressure point can be activated by exerting pressure either on a cup C that is round in shape or on a touch pad PT, arranged above it. The connection between the pressure point PA and the cup C or the touch pad PT is made in the conventional manner.

Finally, the invention relates to a flexible membrane keypad provided with a contact key forming a normally closed type electrical contact as described in connection with FIG. 4. It is to be understood in particular that the key shown in the above mentioned figure can be integrated to form a flexible keypad compatible with all types of materials for the front face FA, such as polyethylene terephthalate (PET), elastomer, Polyurethane (PU), Polycarbonate (PC) or other similar materials.

Shown in FIGS. 5-8 is an example of push button electric switch 10, of the normally closed type. Such a switch is for example, designed to equip a keypad of a portable communication device, such as in particular mobile phones or portable radios.

The switch 10 includes a printed circuit 12 of generally plane shape, having a first face 12A and a second face 12B opposite to the first face 12A.

The first face 12A is generally an upper face intended to be turned towards the exterior of the portable communication device. This first face 12A is in particular shown in the FIG. 1.

The second face 12B is generally a lower face, intended to be turned towards the inside of the portable communication device. This second face 12B is shown in particular in FIG. 2.

The printed circuit 12 has a through orifice 14, allowing access between the first face 12A and the second face 12B. In the example shown, the orifice 14 has a generally rectangular shape in the plane of the printed circuit 12.

As shown in FIG. 1, the printed circuit board has on its first face 12A, a first contact pad 16, also known as contact face. This first contact pad 16 has for example a U-shape and is arranged around the orifice 14 in such a manner that the orifice 14 is partially framed by this first pad 16, along the lengthwise sides and one breadthwise side of this rectangular orifice 14.

As is shown in FIG. 2, the printed circuit 12 includes, on its second face 12B, a second contact pad 18, also known as the contact face, for example of generally rectangular shape. Preferably, the second contact pad 18 is arranged close to the second breadthwise side of the rectangular orifice 14.

The switch 10 also includes a conductor 20, in the form of a flexible conducting strip, designed for electrically connecting the first 16 and second contact pads 18.

The conductor 20 comprises a first part 22, such as shown in FIG. 1, cooperating with the first contact pad 16. Preferably, this first part 22 comprises of two branches 22A, forming the side tabs, and a base 22B, forming a common point between the side tabs, so as to have a U-shape also The branches 22A are arranged on both sides of the orifice 14 of the printed circuit 12, along its lengthwise sides, in such a manner that the orifice 14 is partially framed by this first part 22 in the plane of the orifice 14.

The conductor 20 includes, in addition, a second part 24 extending between a first end 24A connected to the first part 22, and a second free end 24B designed to cooperate with the second contact pad 18.

Preferably, the conductor 20 is made of sheet metal, the first 22 and second 24 parts having been formed integrally.

In the example shown, the second part 24 of the conductor forms a strip (or flexible center tab) extending the base 22B of the first part 22, and extending longitudinally between the two branches 22A of this first part 22. This strip 24 passes through the orifice 14 so as to electrically connect the first part 22 with the second contact pad 18.

Figure 4:
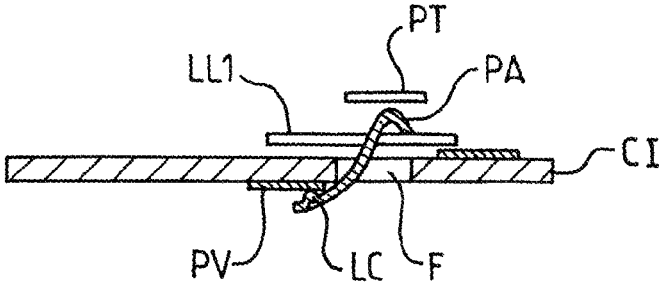
FIG. 4 shows a cross sectional view along the plane of the FIG. 1*d* of a normally closed type electrical contact key according to the object of the present invention.

The second part 24 is elastically deformable between a rest position, shown in FIG. 3, in which its second end 24B cooperates with the second contact pad 18, and a stressed position, shown in FIG. 4, in which its second end 24B is moved away from the second contact pad 18. Thus, the switch 10 is in the closed position when the second part 24 is in its rest position, and it is in its open position when the second part 24 is in its stressed position.

Advantageously, the second part 24 comprises, at its second end 24B, of a boss 25, also called contact face, facilitating contact with the second pad 18.

It should be noted, that due to the elastically deformable structure of the conductor 20, this conductor 20 can be assembled on the printed circuit board 12 by the pinching of the printed circuit 12 between the first 22 and second 24 parts of the conductor 20. This assembly is particularly stable, thanks to the U-shape of the first part 22. This structure thus facilitates the assembly of the switch 10.

The switch 10 also comprises a metal cup 26 of conventional type, forming a pusher/push button, accessible from the side of the first face 12A of the printed circuit 12. This metal cup 26 is arranged above the conductor 20, so that it is capable of cooperating with the second part 24 of the conductor 20. To this end, as shown in FIG. 1, the metal cup 26 is for example arranged in abutment on the first part of the conductor 20.

Such a metal cup 26 can be pushed by a user, in a manner so as to be deformed elastically between a rest position as shown in FIG. 3, and an engaged position as shown in FIG. 4.

In its rest position, the metal cup 26 is held away from the second part 24 of the conductor, which is also found in its resting position. The switch 10 is therefore closed. It should be noted that the height of the metal cup 26 in its position of rest is usually about 1 millimeter. Thus, the switch 10 is compact and can be easily integrated into a compact portable communication device.

In its engaged position, the metal cup 26 cooperates with the second part 24 of the conductor to maintain it in its stressed position. The switch 10 is thus opened.

Advantageously, the second part 24 of the conductor 20 includes a boss 28, forming a pressure point, provided between its first 24A and second 24B ends and intended to cooperate with the metal cup 26 when the metal cup 26 is in its engaged position. This boss 28 makes it possible to ensure contact between the metal cup 26 and the second part 24. Alternatively, the metal cup 26 could bear a similar boss meant for cooperating with the second part 24.

It should be noted that when the user releases the metal cup 26, the metal cup 26 and the second part 24 of the conductor 20 return by elasticity to their respective rest positions.

Preferably, the metal cup 26 is designed to form a hard point, in order to provide a tactile sensation to the user when he actuates the switch 10 by pressing the metal cup 26 with a finger.

The switch 10 preferably comprises some sealing means (not shown), for example of plastic material, covering at least the metal cup 26 and the conductor 20. The sealing means may also include, on the user-side, an inscription relating to the operation of the switch 10.

Such sealing means preferably cover the entire keypad of the communication device so that the device can be used in wet and aggressive environments.

On an optional basis, the switch 10 may also include means for back lighting, arranged on the side of the second face 12B of the printed circuit 12. Indeed, thanks to the orifice 14, it is possible to provide the switch 10 with back lighting in a simple and effective manner.

The previously described switch 10 comprises of few elements, and thus it has a low weight, as well as a low cost.

It should be noted that the invention is not limited to the embodiment that has been described above, but may be presented in different variants without departing from the scope of the claims. In particular, the characteristics of each embodiment described above may be implemented in a manner equivalent to the other embodiment described.

The invention claimed is:

1. A method of manufacturing a flexible membrane keypad comprising of at least one normally closed contact key, the method comprising the steps of:

equipping said keypad with at least one double sided printed circuit comprising at least one front contact face and one back contact face, providing an insertion slot in the printed circuit board between the front contact face and the back contact face, and inserting into said slot, a flexible conducting strip forming a normally closed electrical contact between the front contact face and back contact face, said flexible strip comprising a pressure point so as to enable the exertion of a force for breaking the normally closed electrical contact, wherein said flexible strip includes a flexible center tab comprising said pressure point, that is electrically and mechanically joined with and adjacent to a first side tab and a second side tab through a common point, the first and the second side tabs being located in one and the same plane and the center tab being arranged in an offset position in an orthogonal direction to said plane so as to form a first insertion space and a second insertion space for said flexible strip at said slot, wherein the inserting step comprises the step of:

inserting said flexible strip into the slot by clipping of respectively the first insertion space and the second insertion space on the opposite edges of the slot, so as to bring the flexible center tab to rest and respectively at least one of the first or the second side tab in electrical contact with respectively the back contact face and front contact face or vice versa.

2. The method according to claim 1, wherein the pressure point arranged on the central strip is placed in distant offset position on said center tab in relation to the common point so as to form a cross-force lever between the contact point of the center tab on the back or front contact face and said common point.

3. A normally closed type flexible contact strip for double sided printed circuit board, comprising:

a flexible center tab, a first and a second side tab each electrically and mechanically joined to the flexible center tab at a common point positioned substantially in one and the same plane, laterally adjacent to said flexible center tab, wherein the first and second side tabs being arranged in offset position in an orthogonal direction to said plane to form a first insertion space and a second insertion space of the printed circuit board provided with a slot and at least one front contact face and one back contact face disposed in the vicinity of the two opposite edges of said slot.

4. The normally closed flexible contact strip of claim 3, wherein the pressure point on said center tab is formed by a boss.

5. The normally closed flexible contact strip according to claim 3, wherein:

the flexible center tab comprises a contact face formed by a boss.

6. The normally closed flexible contact strip according to claim 5, wherein:

the first side tab and the second side tab each have a respective contact face formed by a second boss.

7. The normally closed flexible contact strip according to claim 3, wherein the flexible center tab is offset at rest in an oblique plane in relation to the plane containing the first and the second flexible side tabs to form by opposite constrained rotation of the said flexible center tab, the first insertion space and the second insertion space of the printed circuit board between said flexible center tab and said first and second flexible side tabs respectively.

8. The normally closed flexible contact strip according to claim 3, wherein said strip has been derived from at least one of the cutting or stamping of a sheet of conductive material.

9. A contact key flexible membrane keypad, comprising:

a printed circuit board equipped with at least one front contact face and one back contact face each placed in the vicinity of one of the opposite edges of a slot provided in the said printed circuit board, and a flexible contact strip, comprising at least one flexible center tab, and a first and a second side tab each electrically and mechanically joined to the flexible center tab at a common point positioned substantially in one and the same plane, laterally adjacent to said flexible center tab, the first and second side tabs being arranged in offset position in an orthogonal direction to said plane to form a first insertion space and a second insertion space of the printed circuit board provided with a slot and at least one front contact face and one back contact face disposed in the vicinity of the two opposite edges of said slot, wherein the flexible contact strip is inserted in said slot and forms a normally closed electrical contact between the front contact face and the back contact face, said flexible strip having a pressure point for enabling the exertion of a force for breaking the normally closed electrical contact.

10. The contact key for flexible membrane keypad according to claim 9, comprising: at least one of a cup or a touch pad, disposed above the pressure point, capable of cooperating with this pressure point for the actuation by pressure on this cup or the touch pad.

11. The contact key for flexible membrane keypad according to claim 9, wherein the pressure point on said center tab is formed by a boss.

12. The contact key for flexible membrane keypad according to claim 9, wherein the flexible center tab comprises a contact face formed by a boss.

13. The contact key for flexible membrane keypad according to claim 12, wherein the first side tab and the second side tab each have a respective contact face formed by a second boss.

14. The contact key for flexible membrane keypad according to claim 9, wherein the flexible center tab is offset at rest in an oblique plane in relation to the plane containing the first and the second flexible side tabs to form by opposite constrained rotation of the said flexible center tab, the first insertion space and the second insertion space of the printed circuit board between said flexible center tab and said first and second flexible side tabs respectively.

15. The contact key for flexible membrane keypad according to claim 9, wherein said strip has been derived from at least one of the cutting or stamping of a sheet of conductive material.

16. A flexible membrane keypad, comprising at least one contact key, comprising:

a printed circuit board equipped with at least one front contact face and one back contact face each placed in the vicinity of one of the opposite edges of a slot provided in the said printed circuit board, a flexible contact strip, comprising at least one flexible center tab, and a first and a second side tab each electrically and mechanically joined to the flexible center tab at a common point positioned substantially in one and the same plane, laterally adjacent to said flexible center tab, the first and second side tabs being arranged in offset position in an orthogonal direction to said plane to form a first insertion space and a second insertion space of the printed circuit board provided with a slot and at least one front contact face and one back contact face disposed in the vicinity of the two opposite edges of said slot, wherein the flexible contact strip is inserted in said slot and forms a normally closed electrical contact between the front contact face and the back contact face, said flexible strip having a pressure point for enabling the exertion of a force for breaking the normally closed electrical contact.

* * * * *